United States Patent [19]

DiFrancesco

[11] 4,291,970

[45] Sep. 29, 1981

[54] APPARATUS FOR PRODUCING DUPLEX COPIES

[75] Inventor: Alphonse B. DiFrancesco, Penfield, N.Y.

[73] Assignee: Eastman Kodak Company, Rochester, N.Y.

[21] Appl. No.: 98,572

[22] Filed: Nov. 29, 1979

[51] Int. Cl.[3] ..... G03G 15/00

[52] U.S. Cl. ..... 355/3 R; 271/186; 355/3 SH; 355/24

[58] Field of Search ..... 355/3 R, 3 SH, 23, 24, 355/26; 271/65, 186, DIG. 9

[56] References Cited

U.S. PATENT DOCUMENTS

| | | | |
|---|---|---|---|
| 3,318,212 | 5/1967 | Rubin | 355/23 X |
| 3,506,347 | 4/1970 | Carlson | 355/3 |
| 3,536,398 | 10/1970 | Bhagat | 355/23 X |
| 3,548,783 | 12/1970 | Knapp | 118/224 |
| 3,580,670 | 5/1971 | Bhagat | 355/23 X |
| 3,615,129 | 10/1971 | Drawe et al. | 355/26 X |
| 3,630,607 | 12/1971 | Korn et al. | 355/6 |
| 3,645,615 | 2/1972 | Spear | 355/3 |
| 3,671,118 | 6/1972 | Fantuzzo et al. | 355/26 X |
| 3,672,765 | 6/1972 | Altmann | 355/24 |
| 3,687,541 | 8/1972 | Aser et al. | 355/24 X |
| 3,694,073 | 9/1972 | Bhagat | 355/24 |
| 3,697,170 | 10/1972 | Bhagat et al. | 355/16 X |
| 3,697,171 | 10/1972 | Sullivan | 355/24 X |
| 3,702,482 | 11/1972 | Dolcimascolo et al. | 355/3 X |
| 3,775,102 | 11/1973 | Punnett | 355/3 X |
| 3,833,911 | 9/1974 | Caldwell | 271/DIG. 9 |
| 3,844,653 | 10/1974 | Kelly | 355/24 X |
| 3,844,654 | 10/1974 | Guenther | 355/24 |
| 3,866,904 | 2/1975 | Stemmle | 271/65 X |
| 3,869,202 | 3/1975 | Tabata et al. | 355/3 R |
| 3,917,257 | 11/1975 | Caldwell | 271/65 |
| 3,947,270 | 3/1976 | North | 355/3 R X |
| 3,963,345 | 6/1976 | Stemmle et al. | 355/50 |
| 4,035,073 | 7/1977 | Del Vecchio | 355/24 |
| 4,095,979 | 6/1978 | DiFrancesco et al. | 355/26 X |
| 4,174,905 | 11/1979 | DiFrancesco et al. | 355/14 R |
| 4,212,529 | 7/1980 | O'Brien et al. | 355/3 R |

FOREIGN PATENT DOCUMENTS

| | | | |
|---|---|---|---|
| 1450842 | 9/1976 | United Kingdom | 355/14 |

*Primary Examiner*—Fred L. Braun
*Attorney, Agent, or Firm*—William F. Noval

[57] ABSTRACT

Apparatus for producing images on first and second sides of a copy sheet. Unfixed transferable images formed on an image transfer member are transferred to the opposite sides of a copy sheet brought into transferable relationship with the image transfer member. A copy sheet handling apparatus includes a vacuum member movable in opposite directions. The vacuum member is moved between first and second positions spaced from one another. At the first position, the vacuum member overlies the transfer member and is moved in one direction in synchronism therewith to separate a copy sheet to one side of which a first transferable image has been transferred. At the second position, the vacuum member is aligned with the transfer member and is moved in an opposite direction to bring the second side thereof into transferable relationship with the second transferable image on the transfer member.

9 Claims, 8 Drawing Figures

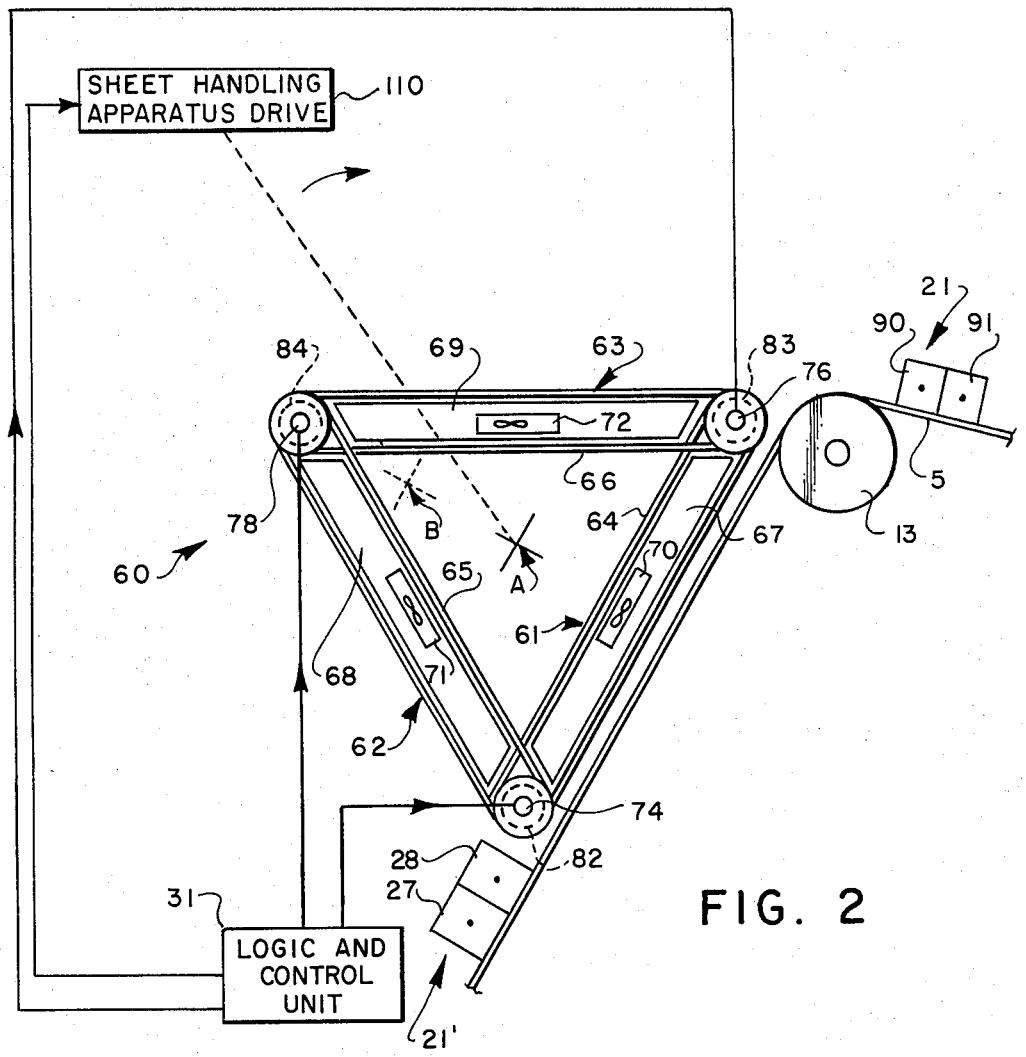
FIG. 2
FIG. 3
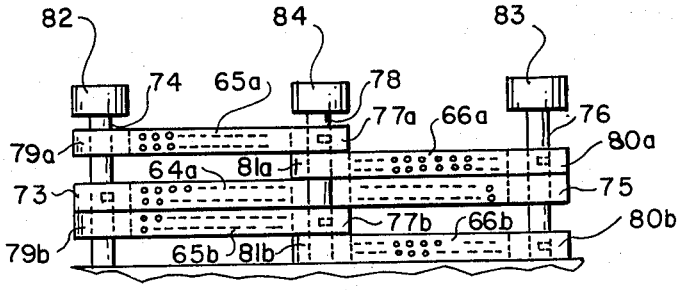

APPARATUS FOR PRODUCING DUPLEX COPIES

BACKGROUND OF THE INVENTION

This invention relates to apparatus for producing duplex copies. More particularly, this invention relates to apparatus for transferring unfixed transferable images to opposite sides of a succession of copy sheets.

Several techniques are known in the prior art for forming duplex images on a final copy medium such as a web or sheet. One such technique requires the use of two photoconductors upon which first and second transferable images are formed respectively. The copy medium is generally passed between the photoconductors and the first and second images are transferred to opposite sides of the copy medium. Another technique similar to the above but involving the use of only one photoconductor, utilizes an intermediate image storage member such as a drum, to receive the first image formed on the photoconductor before transfer to a final copy medium. These techniques suffer the disadvantages of increased cost, machine complexity and size and decreased reliability necessitated by the use either of two photoconductive and optical systems or of additional components before transfer to a final copy medium.

A further duplexing technique utilized in certain commercial electrophotographic machines utilizes a "two-pass" process wherein copies developed sequentially on the first sides of a plurality of copy sheets by an electrographic process are collected in an intermediate tray and fed seriatim back through the process to develop second fixed images on the second sides of the copy sheets, thus producing duplex copies. This process is disadvantageous for several reasons. First, a duplex copy is not available for inspection until all of the first sides of the copy sheets and one set of the second sides thereof have been developed. In addition, the relatively long paper paths required in passing a copy sheet through the electrophotographic process twice greatly increases the possibility of paper jams and other potential copy handling complications. Moreover, environmental conditions of image formation and the physical parameters of the copy sheet may change resulting in images of varying quality on opposite sides of a single sheet and misregistration between images on opposite sides of a copy sheet may also result.

Another duplex copying technique involves fixing images to both sides of a copy sheet having a single pass through the disclosed electrophotographic processes. U.S. Pat. No. 3,506,347; 3,672,765; 3,869,202; and 3,947,270 disclose various embodiments of this technique. In the patent just listed a first tackified image is formed on a transfer drum, the image is transferred to the first side of a copy sheet, and the sheet is inverted while the first tackified image dries and becomes fixed on the copy sheet. Thereafter, a second tackified copy image is formed on the transfer drum and the copy sheet is fed back into contact with the drum to transfer the second image to the second side of the copy sheet which is then transported to an output tray. In the latter three patents, electrophotographic apparatus is disclosed for making copies wherein two images of an original are formed sequentially on a photoconductor, the images are developed and the first developed image is transferred to the first side of a copy sheet. The copy sheet is passed through a fuser to fuse or fix the first transferred image, is turned over and the opposite side of the copy sheet is brought into contact with the second developed image on the photoconductor. The second image is then transferred to the second side of the copy sheet, the copy sheet separated from the photoconductor and the second image fused by means of a second fuser. The disclosed techniques have several disadvantages. Since the first image is fixed before transfer of the second image, either two fusers must be used with attendant increase is cost, power and environmental heat or solvent fixing is used resulting in safety hazards and the inconvenience of handling consumable liquids.

U.S. Pat. No. 4,035,073 discloses a reproduction apparatus wherein first and second toner images are alternately formed on the first sides of a series of three copy sheets, the first sides of the first and third sheets receiving the first image and the first side of the second sheet receiving the second image. The copy sheets are then fed along a conveyer belt with the side carrying the toner image contacted first by a lifter mechanism and then by a conveyor belt. The three sheets are then brought back into contact with the drum so that the second sides of the first and third sheets receive the second images and the second sheet receives the first image. This apparatus is disadvantageous in that three sheets must be processed before a duplex copy is ready for inspection. Furthermore, the long copy sheet paths and long times between first and second image transfer to a copy sheet increases the likelihood of image quality variations on opposite sides of a sheet due to changes in environmental conditions. In addition, image blurring and degradation is greatly increased through contacting the imaged side during copy sheet inversion by the lifter and belt.

In U.S. Pat. No. 4,095,979, issued June 20, 1978, there is disclosed a single pass duplexing technique utilizing a reversible vacuum belt for inverting a copy sheet to the first side of which an unfixed image has been transferred by contacting the unimaged second side of the sheet.

A further disadvantage of many of the known duplexing techniques is the inability to handle heavy copy sheet stock. Most of these techniques are designed to handle copy sheet stock which is quite flexible and capable of being transported through paths having relatively sharp turns. Heavier paper and card stock may be relatively inflexible and incapable of negotiating such sharp sheet paths.

SUMMARY OF THE INVENTION

The present invention alleviates the above and other disadvantages of prior duplex copiers. According to one feature of the invention, a single copying process is provided resulting in decreased cost, size, and complexity and increased reliability with no image degradation since no intermediate storage member is used. According to another feature of the invention, unfixed images are formed on either one or both sides of a copy sheet before fixing of the images thus eliminating the need for a second fuser resulting in a decrease in power usage, environmental heat and cost or for solvent fixing thus eliminating safety hazards and the inconvenience of replenishing liquids. Another feature of the invention reduces the length of the copy path from that required for "two-pass" duplexing thus reducing side to side copy quality variability and misregistration and the incidence of paper jams. Still another feature of the invention is the ability to process copy sheets without appreciably bending them thus enabling handling of relatively inflexible copy sheets.

In general, according to the present invention, there is provided apparatus for producing images on first and second sides of a copy sheet through the transfer of unfixed transferable images formed on an image transfer member to the opposite sides of a copy sheet brought into transfer retationship therewith. The apparatus includes copy sheet handling means including a vacuum member movable in opposite directions. The vacuum member is moved between at least first and second spaced positions. At the first position, the vacuum member overlies the transfer member and is moved in one direction to separate a copy sheet to one side of which a first transferable image has been transferred. At the second position, the vacuum member is moved in an opposite direction after separation of the copy sheet from the transfer member to bring the second side thereof into transferable relationship with the second transferable image on the transfer member.

The invention and its features and advantages will be set forth and become more apparent in the detailed description of the preferred embodiment presented below.

BRIEF DESCRIPTION OF THE DRAWINGS

In the detailed description of the preferred embodiment of the invention presented below, reference is made to the accompanying drawings, in which:

FIG. 2 is a diagrammatic elevational view of the copy sheet handling apparatus shown in FIG. 1;

FIG. 3 is a diagrammatic partially plan view of the apparatus of FIG. 2;

ELECTROPHOTOGRAPHIC COPIER

Figure 1:
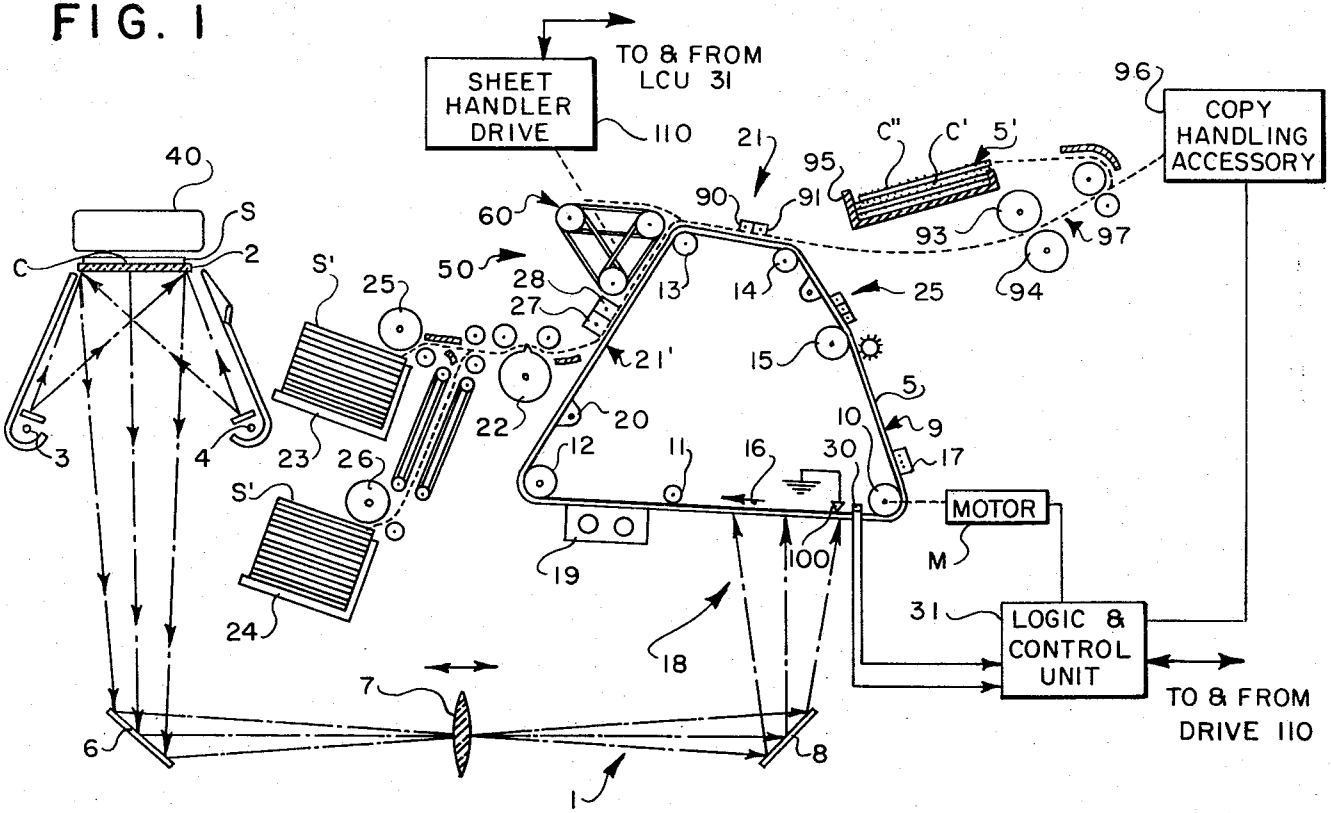
FIG. 1 is a schematic diagram of duplex apparatus incorporating an embodiment of the copy sheet handling apparatus of the present invention.

Referring now to FIG. 1, there is schematically illustrated electrophotographic apparatus 1 (referred to herein as a copier) including a copy sheet handling apparatus according to the present invention. Only those features of the copier which are helpful for a full understanding of the preferred embodiment are described hereinafter. However, more complete description of the copier may be found in commonly assigned U.S. Pat. No. 3,914,047, patented: Oct. 21, 1975, in the names of Hunt et al.

In order to make a copy, a document may be placed manually or automatically on top of exposure platen 2. Documents having images on either one or both sides may be copies to form duplex copies. In the former case, two successive documents are placed on platen 2 to produce a single duplex document. In the latter case, the document is turned over to sequentially expose both sides of the document.

As shown, recirculating feeder 40 is positioned on top of exposure platen 2. The recirculating feeder may take the form of that disclosed in U.S. Pat. No. Re. 27,976 wherein a plurality of sheets of a document having images only on first sides of the sheets can be repeatedly fed in succession from an originating stack to the exposure platen 2 of copier 1. Alternatively, the feeder may be capable of turning over a document to feed both sides to the exposure platen. In either case, feeder 40 places a selected side C of a sheet of an original document S with the selected side C facing an exposure platen 2 of the copier 1. The platen 2 is constructed of transparent glass. When energized, two xenon flash lamps 3 and 4 illuminate the selected side C of the original sheets S. By means of an object mirror 6 a lens 7, and an image mirror 8, a light image of the selected side C is reflected back from the exposure platen 2 and projected as an inverse or mirror image onto a discrete section of an image transfer member such as photoconductive member 5.

Photoconductive member 5 has a photoconductive layer 9 overlying a conductive layer (not shown) and a transparent support backing and is trained about six transport rollers 10, 11, 12, 13, 14 and 15 as an endless or continuous belt. The conductive layer is grounded by means of brushes 100. Roller 10 is coupled to a drive motor M in a conventional manner. Motor M is actuated by a signal from logic and control unit (LCU) 31. When motor M is actuated, the roller 10 is driven by the motor M and moves member 5 in a clockwise direction indicated by arrow 16. This movement causes successive sections of member 5 constituting image frames to sequentially pass a series of electrophotographic work stations.

For the purpose of the instant disclosure, the several work stations along the path of movement of member 5 may be described as follows:

A charging station such as corona charger 17 at which the photoconductive layer 9 of member 5 is sensitized by receiving a uniform electrostatic charge;

an exposing station 18 at which the inverse image of the selected side C of the original sheet S is projected onto the photoconductive layer 9 of member 5; the image dissipates the electrostatic charge at the exposed areas of the photoconductive layer and forms a latent electrostatic image thereon which corresponds to the indicia on the selected side C of the original sheet S;

a developing station such as a magnetic brush developer 19 at which developing powder, including toner particles having an electrostatic charge opposite to that of the latent electrostatic image, is brushed over photoconductive layer 9 and causes the toner particles to adhere to the latent electrostatic image to visibly form a toner particle image which is a mirror resemblance of the indicia on the selected side C of the original sheet S;

a post development erase station 20 at which member 5 is illuminated to reduce photoconductor fatigue, i.e., its inability to accept or hold an electrostatic charge;

copy duplex station 50 (to be described in greater detail later) at which first and second unfixed toner images are electrostatically transferred from member 5 to opposite sides of a copy sheet S′ before either image is fixed to sheet S′; and a cleaning station 25 at which photoconductive layer 9 of member 5 is cleaned of any residual toner particles remaining thereon after the toner images have been transferred and is discharged of any residual electrostatic charge remaining thereon.

The details and operation of such a copier is shown in greater detail in U.S. Pat. No. 3,914,047, the contents of which is hereby incorporated by reference.

For the purposes of the present invention, first and second sequential unfixed toner images are formed on member 5 in accordance with the above described sequence of operations of electrophotographic apparatus 1.

Copy duplex station 50 includes a first image transfer station 21', copy sheet handling apparatus 60 and a second image transfer station 21. Copy sheets S' are supported in supplies 23 and 24. A copy sheet S' is transported from either of supplies 23 or 24 by vacuum rollers 25 or 26, respectively, to a sheet registration device 22 where movement of sheet S' is arrested to synchronize its arrival at first image transfer station 21' in registration with the arrival of the first unfixed toner image at station 21'. At transfer station 21', the first toner image on member 5 is transferred to the first side C' of copy sheet S'; by electrostatic means such as a corona charger 27. Detack charger 28 neutralizes the negative charge on copy sheet S' so that it can be easily separated from member 5.

Copy sheet handling apparatus 60 is shown in greater detail in FIGS. 2 and 3 and includes first, second, and third vacuum members 61, 62, 63 mounted in a triangular configuration on a suitable frame (not shown). Vacuum members 61, 62, 63 may comprise, for example, endless perforated belts 64, 65, 66 disposed within which are vacuum plenums 67, 68, 69 respectively having vacuum exhaust fans 70, 71, 72. Plenums 67, 68, 69 may also be connected to a common vacuum source (not shown).

Belt 64 is shown as including a plurality of strands 64*a*, etc., disposed across the width of apparatus 60 and trained about roller 73 pinned to shaft 74 and roller 75 freely supported on shaft 76. Belt 65 includes a plurality of strands 65*a*, 65*b*, etc., trained about rollers 77*a*, 77*b* pinned to shaft 78 and rollers 79*a*, 79*b* freely supported on shaft 74. Belt 66 includes strands 66*a*, 66*b*, etc. trained about rollers 80*a*, 80*b* pinned to shaft 76 and rollers 81*a*, 81*b* freely supported on shaft 78.

Each of vacuum belts 64, 66, and 65 are mounted for movement in opposite directions by means of motors 82, 83, 84 driving shafts 74, 76, 78 respectively. Each belt is repetitively moved to first, second, and third positions. As shown in FIG. 2, belt 64 is in the first position, belt 66 is in the second position, and belt 65 is at the third position.

At the first position, the belt overlies and is substantially parallel to the course of photoconductive member 5 between rollers 12 and 13 and is moved in one direction in synchronism with member 5 to separate a copy sheet having a toner image transferred to one side thereof at first transfer station 21'. At the second position spaced from the first position, the belt is aligned with a course of member 5 between rollers 13 and 14 which is angularly related to the course between rollers 12 and 13 and is moved in an opposite direction in synchronism with belt 5 to bring the other side of the copy sheet into transfer relationship with a second toner image on member 5. At the third position, the belt is inoperative. In the first and second positions, the vacuum is maintained to attract and hold a copy sheet to the member. In the third position, the vacuum need not be maintained.

Figure 6:
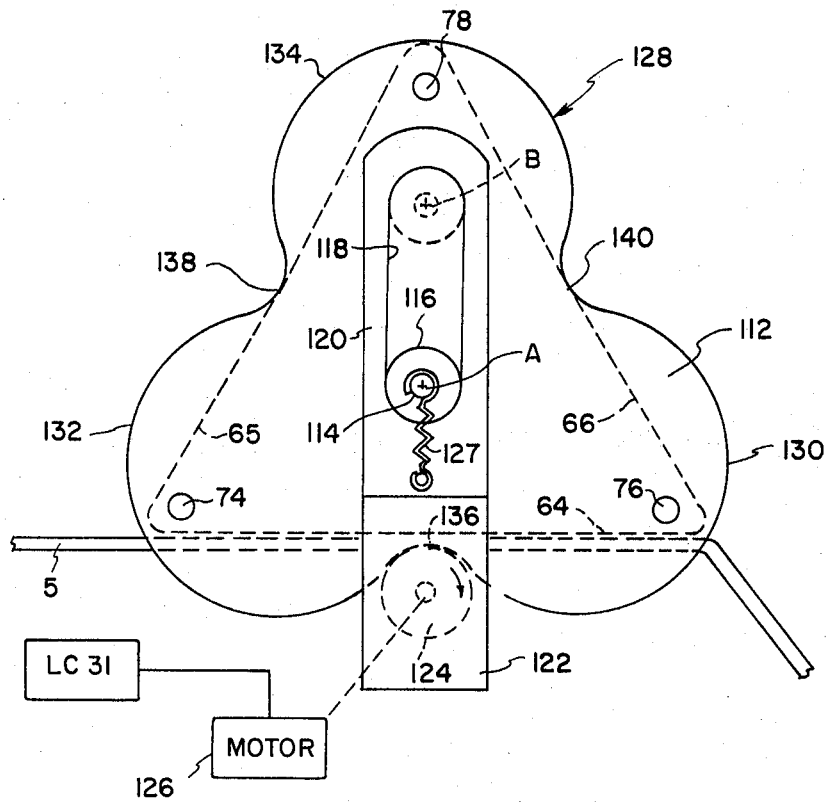
FIG. 6 is a diagrammatic elevational view of an illustrative drive for the sheet handling apparatus.

Copy sheet handling apparatus 60 is moved both translationally between A and B and rotationally by means of drive 110. Drive 110 may be any suitable mechanical, pneumatic, or electrical arrangement, known to those skilled in the art, which effects such motions. An illustrative drive is shown in FIG. 6 and will be described later. Drive 110 is actuated by a signal from logic and control unit 31.

Figure 4B:
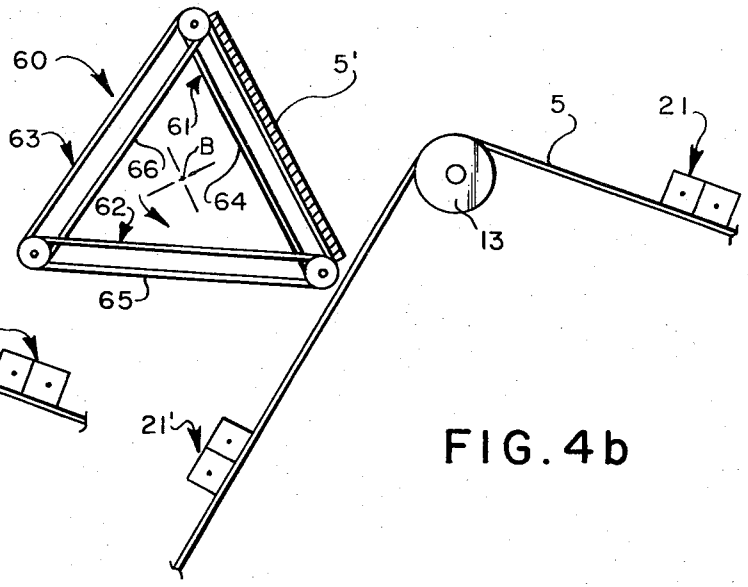
FIGS. 4A–C are diagrammatic elevational views of the apparatus of FIG. 2 showing different stages during copy sheet handling.
Figure 4A:
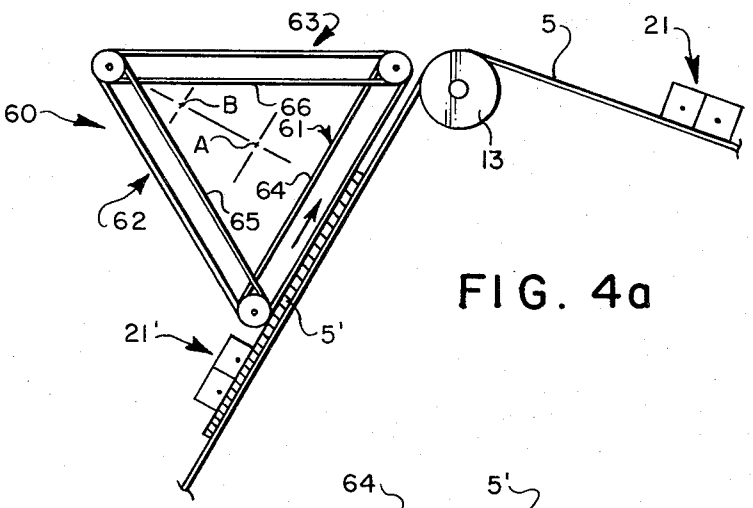
Figure 4C:
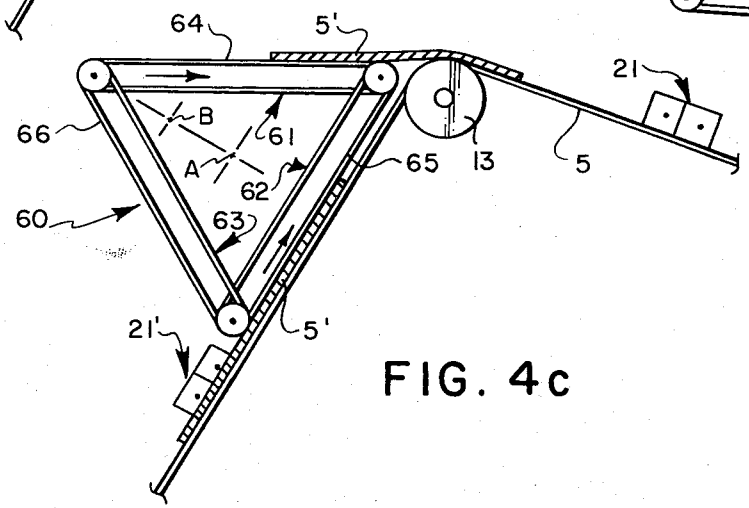

Referring now to FIGS. 4*a*–4*c*, there is shown in greater detail the operation of copy sheet handling apparatus 60 according to the present invention. In FIG. 4*a*, vacuum belt 64 of assembly 61 is shown in a first position parallel to and closely overlying member 5. Belt 64 is moved in one direction in synchronism with member 5 to separate by vacuum attraction a copy sheet S' from member 5 after transfer of a first unfixed image to a first side of copy sheet S' at first transfer station 21'. After sheet S' has been separated from member 5, belt 64 is stopped. Apparatus 60 is then moved away from member 5 by drive 110 until its center is located at B so that it clears member 5. As shown in FIG. 4*b*, apparatus 60 is rotated about 60° in a counterclockwise direction. During rotation, copy sheet S' is inverted without disturbing the first unfixed image on the first side thereof since only the unimaged second side of copy sheet S' has been contacted by belt 64.

As shown in FIG. 4*c*, apparatus 60 has been rotated 120° by drive 110. Belt 64 is now in the second position, substantially aligned with the course of member 5 between roller 13 and station 21. Belt 64 is moved in an opposite direction in synchronism with member 5 to bring the second side of copy sheet S' into transferable relationship with the second unfixed toner image on member 5 at second transfer station 21. Belt 65 is now overlying member 5 at the first position and is moved such that the course of belt 65 adjacent to member 5 moves in the same direction as and at the speed of member 5 to separate the next sheet S' after transfer of the first image of the next document S placed on platen 2. The sequence of operation of FIGS. 4*a*–4*c* is then repeated with belt 65 being moved to the second position, belt 64 to the third position where it is inoperative, and belt 66 to the first position. It will be noted that during repositioning of copy sheet S', it is maintained substantially flat and is not subject to movement around sharp turns as in some known duplexing techniques. Thus copy sheets of relatively stiff and inflexible material may be readily utilized in the duplex process of FIG. 1.

Referring to FIG. 6, there is shown an illustrative drive 110 for copy handling apparatus 60. Drive 110 includes cam plates 112 (only one of which is shown) mounted on either end of apparatus 60. As shown, plates 112 form part of the supporting frame for apparatus 60 and shafts 74, 76, 78 are thus journalled in plates 112. Each plate 112 has a centrally disposed pin 114 upon which is mounted roller bearing 116 adapted to ride in slot 118 of bracket 120. Bracket 120 has an angled portion 122 which is mounted on the copier frame. Cam roller 124 engages the outer surface of plate 112 and is driven by motor 126. Spring 127 biases plate 112 against roller 124 to maintain engagement therebetween. The surfaces of plate 112 and roller 124 are of high friction material such as rubber to provide non-slipping drive between roller 124 and plate 112. Alternatively, roller 124 and plate 112 may be provided with meshing gear teeth.

The periphery 128 of plate 112 forms a continuous curve having three lobes 130, 132, 134 separated by notches 136, 138, 140. Notches 136, 138, 140 are located midway between the ends of belts 64, 65, 66 respectively, and establish the location of a belt at the first position when roller 124 is seated in the respective notch. Thus, as shown in FIG. 6, apparatus 60 is at rest, roller 124 is inoperative and is seated in notch 136 in engagement with surface 128 of plate 112, and belt 64 is in the first position overlying member 5.

In the operative of drive 110, after belt 64 has separated a copy sheet from member 5, LC 31 sends a signal to motor 126 to rotate roller 124 in a clockwise direction. Rotation of roller 124 effects rotation and translation of plate 112 and thus apparatus 60 through the driving engagement of the surface of roller 124 with surface 128 of plate 112. As roller 124 moves along surface 128 over lobe 132 to notch 138, bearing 116 moves from A to B riding in slot 118 until it reaches the position indicated in dashed lines at the other end of slot 118. At this position of bearing 116, roller 24 has travelled half-way between notches 136 and 138 and plate 112 and apparatus 60 have been rotated approximately 60°.

Continued rotation of roller 124 causes bearing 116 to move back to A and brings belt 65 into overlying relationship with member 5 at the first position. When roller 124 is seated in notch 138, LC 31 deactivates roller 24. Belt 64 has been moved to the second position in alignment with member 5 where it brings the copy sheet it carries back into transfer relationship with member 5. Belt 66 has been moved to the third position and is inoperative.

Roller 124 is activated and deactivated by LC 31 in synchronism with the feeding of copy sheets into transfer relationship with images formed on member 5, such that each belt 64, 65, 66 is successively moved to the first, second, and third positions during a complete revolution of plate 112.

Although copy sheet handling apparatus 60 is shown as including three vacuum members arranged in a triangular configuration, it will be understood that more or less vacuum members arranged in other configurations are contemplated to be within the scope of the present invention. For example, four vacuum members could be arranged in a square configuration, etc. Belts 64, 65, 66 may be mounted on separate shafts instead of common shafts as shown in the figures and thus may include single perforated belts extending the width of member 5, instead of a plurality of strands.

At second transfer station 21, the second toner image on member 5 is transferred to the second side C′ of sheet S′ by second transfer corona charger 90. Second detack charger 91 neutralizes the negative charge on copy sheet S′ so that it can be separated a second time from member 5.

After transfer of both unfixed toner images to copy sheet S′, it is transported to a fuser 92 which includes opposed rolls 93 and 94. Where the toner particles forming the images on sheet S′are heat fusible, rolls 93, 94 are both heated to heat fuse both toner images to the opposite side of sheet S, respectively. Where the toner particles are pressure fusible, rolls 93, 94 need not be heated and fixing to sheet S′ is effected through pressure alone.

Duplex copy sheet S′ may be transported to an output tray 95 or to a copy handling accessory 96 such as a stapler/stacker where the sheets may be stacked in a straight or offset manner or where groups of copy sheets corresponding to the sheets of the original may be stapled into booklets.

Logic and Control Unit

Figure 5:
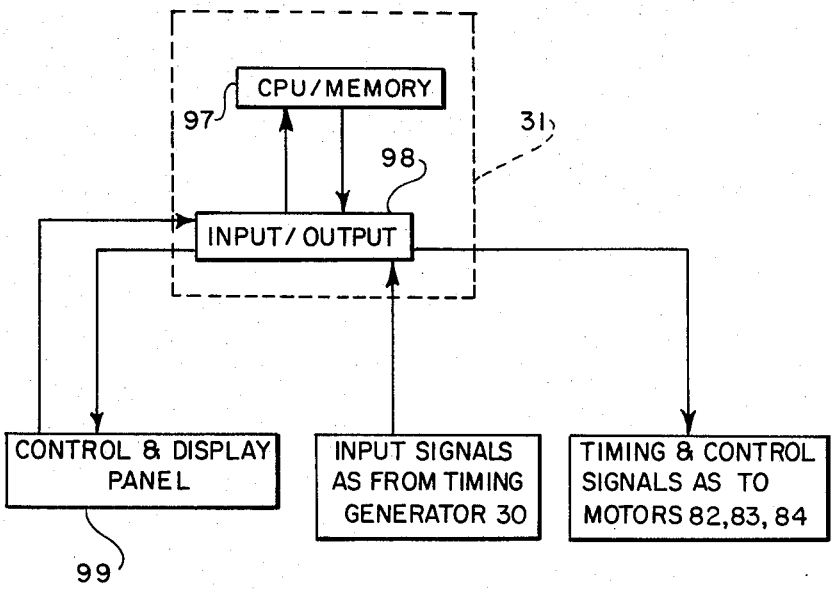
FIG. 5 is a block diagram of the control unit of FIG. 1.

As shown in FIG. 1, and more particularly in FIG. 5, operation of copier 1 and its related accessories such as feeder 50 and copy handling accessory 96 is monitored and controlled by a digital microprocessor incorporated in logic and control unit (LCU) 31. LCU 31 may include a central processing unit (CPU) which processes data in digital format, a program memory such as a read only memory (ROM) which stores basic logic and control subroutines and a random access memory (RAM) which is used for temporary memory and for maintaining a short-term account of the flow of original documents and of copies being processed. Module 98 provides all of the control signals and data bus connections to communicate with the CPU, ROM and RAM of module 97.

A control and display panel 99 is provided on copier 1 and includes operator selectable switches and controls for such functions as number of copies desired, choice of simplex or duplex copying etc. and also includes displays to indicate information such as number of copies selected, number of copies produced, jam conditions in the copier or its accessories, etc. Input signals to LCU 31 are derived from various switches, sensors and the like which monitor copier operation, track the passage of copy sheets, etc., and from a timing generator 30. As disclosed in U.S. Pat. No. 3,914,047, member 5 may include a series of perforations along an edge thereof which are sensed by a sensor such as piezoelectric or optic sensor 30. The perforations provide a means of generating timing signals which are related to the movement of member 5 and which are used to synchronize the various mechanisms of copier 1 and its accessories with the location of the images formed on member 5.

Output signals from LCU 31 control the various work stations of copier including turning drive motor M on and off, initiating flash lamps 3 and 4 and controlling the operation of copy sheet handling means 60 which will now be described in detail.

Successive pairs of first and second toner images are formed on member 5 and are transferred to the opposite sides of copy sheets fed seriatim from supplies 23, 24. After first and second toner images have been formed on member 5, a copy sheet is fed from either of supplies 23, 24 and a first side thereof is registered by registration device 22 with the first toner image on member 5 at first transfer station 21′. LCU 31 has sent a signal to motor 82 to cause it to rotate in a counterclockwise direction (as seen in FIG. 2) to move belt 64 at a speed equal to member 5. As sheet S′ passes under belt 64 it is sucked up into contact therewith until sheet S′ has completely separated from member 5.

LCU 31 then sends signals to motor 82 to stop belt 64 and to drive 110 to move apparatus 60 both translationally and rotationally so that is is moved away from member 5 with the center of rotation of apparatus 60 being moved from A to B. As apparatus 60 is rotated further, the center of rotation of apparatus 60 is moved back to A with belt 65 at the first position, overlying member 5 and belt 64 at the second position in substantial alignment with member 5. LCU 31 then sends a signal to motor 82 to reverse the direction of belt 64 and move it at the speed of member 5 so that sheet S′ is brought into transferable relationship with the second image on member 5 at second transfer station 21. A signal is also sent by LCU 31 to motor 84 to move belt 65 at the speed of member 5 to separate the next succeeding sheet S′ from transferable relationship with member 5. Belt 66 is at the third position and is inoperative. The process is then repeated to successively move belts 66, 65, and 64 to the first, second, and third positions.

The invention has been described in detail with particular reference to preferred embodiments thereof, but it will be understood that variations and modifications can be effected within the spirit and scope of the invention.

What is claimed is:

1. In apparatus for producing images on first and second sides of a copy sheet and including a movable image transfer member upon which first and second unfixed transferable images may be formed, copy sheet handling means comprising:

a vacuum member movable in opposite directions, and means for moving said vacuum member between (a) a first position overlying said image transfer member and at which said vacuum member is moved in synchronism with the image transfer member in one direction to separate by vacuum attraction a copy sheet to one side of which a first transferable image has been transferred from said transfer member, and (b) a second position, spaced from the first position, and to which the vacuum member is moved after separation of the copy sheet from said transfer member, said vacuum member being moved in the opposite direction in synchronism with the image transfer member when in said second position to bring the second side of the copy sheet into transferable relationship with the second transferable image on the transfer member.

2. In apparatus for producing images on first and second sides of successive copy sheets and including a movable image transfer member for receiving first and second unfixed transferable images, copy sheet handling means comprising:

a first vacuum member movable in opposite directions;

a second vacuum member movable in opposite directions; and means for moving said first and second vacuum members simultaneously between a first position at which (a) said first vacuum member closely overlies and moves synchronously in the same direction as said image transfer member to separate by vacuum attraction a copy sheet carrying on its first side a first transferable image received from the image transfer member; and (b) the second vacuum member is spaced from the transfer member; and a second position at which (a) the first vacuum member carrying the copy sheet is moved in the opposite direction in synchronism with the image transfer member to bring the second side of the copy sheet into transferable relationship with the second image on the transfer member and at which (b) the second vacuum member replaces the first vacuum member in said first position so as to separate a successive sheet from the image transfer member.

3. In apparatus for producing images on opposite sides of a succession of copy sheets and including a movable photoconductive member for receiving successive pairs of first and second unfixed toner images and first and second transfer stations for successively transferring toner images of a pair to the first and second sides respectively of a succession of copy sheets, copy sheet handling means comprising:

a first vacuum member movable in opposite directions;

a second vacuum member movable in opposite directions;

means for moving said first and second vacuum members simultaneously between a first position at which (a) said first vacuum member is overlying a first portion of the photoconductive member and is moved in one direction in synchronism with said photoconductive member to separate by vacuum attraction a copy sheet to the first side of which a first transferable image has been transferred by the first transfer station from the photoconductive member and (b) the second vacuum member is spaced from the photoconductive member, and a second position at which (a) said first vacuum member, carrying said copy sheet, is located in close proximity to, and is moved in the opposite direction in synchronism with, said photoconductive member to bring the second side of the copy sheet into transferable relationship with the second image on the photoconductive member at the second image transfer station, and (b) the second vacuum member is overlying said photoconductive member in place of the first vacuum member to separate the next copy sheet from the photoconductive member, and wherein said means for moving, moves the second vacuum member to replace the first vacuum member in the latter's second position for feeding said next copy sheet to the photoconductive member in a manner similar to transfer of the first copy sheet by the first vacuum member.

4. Apparatus for producing images on opposite sides of a succession of copy sheets, comprising:

a movable image transfer member for receiving successive pairs of first and second unfixed transferable images;

first and second transfer stations for transferring transferable images of a pair to the opposite sides respectively of a succession of copy sheets;

first, second, and third vacuum members arranged in a substantially triangular configuration, located between said transfer stations, each of said vacuum members being movable in opposite directions;

means for repetitively moving each of said vacuum members successively between first, second, and third positions wherein at said first position the vacuum member is overlying a portion of the image transfer member and is moved in one direction in synchronism with the image transfer member to separate a copy sheet to one side of which a first transferable image has been transferred from the transfer member at said first transfer station;

at said second position the vacuum member, carrying said copy sheet, is located in close proximity to, and is moved in the opposite direction in synchronism with said transfer member to bring the other side of the copy sheet into transferable relationship with the second image on the transfer member at the second image transfer station; and at said third position the vacuum member is inoperative.

5. The apparatus of claim 4 wherein said vacuum member comprises belt means having a course which is adjacent to and substantially parallel to the transfer member at the first position to receive a copy sheet and which, at the second position, is substantially aligned with the image transfer member to bring the copy sheet into transfer relationship with the transfer member without substantial bending of the sheet.

6. The apparatus of claim 4 wherein said transfer member is in the form of a belt which is constrained between said first and second image transfer stations such that its path of travel to the second station is angularly related to its path adjacent to a vacuum member at the first position, said vacuum member being substantially aligned with said path of travel of said transfer member to the second station when at the second position.

7. The apparatus of claim 4 wherein said image transfer member comprises a photoconductive member for receiving successive pairs of first and second toner images.

8. The apparatus of claim 4 including means for mounting said vacuum members for movement toward and away from said transfer member and for rotary movement between said first, second and third positions.

9. The apparatus of claim 8 wherein said means for moving includes cam plate means supported by said means for mounting and driven roller means in contact with said cam plate means.

* * * * *